US009641930B2

(12) United States Patent
Chou

(10) Patent No.: US 9,641,930 B2
(45) Date of Patent: May 2, 2017

(54) WATERPROOF PIEZOELECTRIC CERAMIC SPEAKER

(71) Applicant: ZIPPY TECHNOLOGY CORP., New Taipei (TW)

(72) Inventor: Chin-Wen Chou, New Taipei (TW)

(73) Assignee: ZIPPY TECHNOLOGY CORP., New Taipei (TW)

( * ) Notice: Subject to any disclaimer, the term of this patent is extended or adjusted under 35 U.S.C. 154(b) by 557 days.

(21) Appl. No.: 13/661,517

(22) Filed: Oct. 26, 2012

(65) Prior Publication Data

US 2014/0119587 A1 May 1, 2014

(51) Int. Cl.

| | |
|---|---|
| ***H04R 25/00*** | (2006.01) |
| ***H04R 1/44*** | (2006.01) |
| *H04R 17/10* | (2006.01) |

(52) U.S. Cl.

CPC ..... *H04R 1/44* (2013.01); *H04R 17/10* (2013.01)

(58) Field of Classification Search

CPC ..... H04R 1/005; H04R 1/02; H04R 1/025; H04R 1/026; H04R 1/2807; H04R 1/2869; H04R 1/2873; H04R 1/2884; H04R 1/2888; H04R 1/2892; H04R 1/2896; H04R 1/403; H04R 17/00; H04R 17/10; H04R 2499/11; H04R 2499/15; H04R 7/06; H04R 7/10; H04R 2440/05; H04R 2201/02; H04R 2201/023

USPC ..... 381/334, 332, 87, 336, 311, 386, 335, 381/189–191, 393

See application file for complete search history.

(56) References Cited

U.S. PATENT DOCUMENTS

| | | | | |
|---|---|---|---|---|
| 4,079,213 | A * | 3/1978 | Bage et al. | 381/163 |
| 4,807,294 | A * | 2/1989 | Iwata | H04R 7/06 310/322 |
| 5,196,755 | A * | 3/1993 | Shields | 310/324 |
| 5,388,162 | A * | 2/1995 | Sohn | 381/160 |
| 5,802,196 | A * | 9/1998 | Nakamura | 381/423 |
| 2002/0115344 | A1* | 8/2002 | Chen | 439/587 |
| 2007/0253591 | A1* | 11/2007 | Popilek et al. | 381/388 |
| 2010/0172215 | A1* | 7/2010 | Liu et al. | 367/140 |

FOREIGN PATENT DOCUMENTS

| | | |
|---|---|---|
| TW | I274522 | 2/2007 |
| TW | M415529 | 11/2011 |
| TW | M426235 | 4/2012 |

* cited by examiner

*Primary Examiner* — Amir Etesam

(74) *Attorney, Agent, or Firm* — Muncy, Geissler, Olds & Lowe, P.C.

(57) ABSTRACT

A waterproof piezoelectric ceramic speaker includes a ceramic composite and a vibration membrane. The ceramic composite includes a ceramic plate and a driving electrode assembly arranged on the ceramic plate and supplying a driving voltage to the ceramic plate to generate vibration for the ceramic plate. The vibration membrane includes a first vibration layer and a second vibration layer respectively adhered to two opposite surfaces of the ceramic composite. The first vibration layer and the second vibration layer respectively have a resonance member adhered to the ceramic plate and resonating with the ceramic plate synchronously, a waterproof member connecting with the resonance member to seal the driving electrode assembly, and a bonding member extending from a perimeter of the resonance member to seal the resonance member.

6 Claims, 5 Drawing Sheets

WATERPROOF PIEZOELECTRIC CERAMIC SPEAKER

FIELD OF THE INVENTION

The present invention relates to a piezoelectric ceramic speaker, particularly to a waterproof piezoelectric ceramic speaker using two vibration layers to achieve a effect on high resonance and waterproofing.

BACKGROUND OF THE INVENTION

The piezoelectric ceramic speaker works in a principle distinct from that of the electro dynamic speaker. In the piezoelectric ceramic speaker, varying voltage is applied to the piezoelectric material to result in deformation of the piezoelectric material and vibration of the air to generate sounds. The electro dynamic speaker converts electric energy into magnetic energy and further converts magnetic energy into mechanical energy. However, the piezoelectric ceramic speaker directly converts electric energy into mechanical energy so that it has higher energy conversion efficiency. The electro dynamic speaker uses coils, generates electromagnetic field, consumes a lot of power, and generates electromagnetic interference. Contrarily, the piezoelectric ceramic speaker is free of all the above-mentioned problems and has the advantages of compactness and low power consumption. Therefore, piezoelectric ceramic speakers are widely used in smart phones and small electronic products.

The piezoelectric ceramic speaker generates high-frequency sounds but not low-frequency sounds. An approach to increase waterproofness of the piezoelectric ceramic speaker is to increase the density of the ceramic plate therein. However, increasing the density of the ceramic plate also increases the frequency of the sound generated by the piezoelectric ceramic speaker, which is shrill and harsh to the ears. Taiwan patents of No. M415529, No. M426235, and No. I274522 disclosed piezoelectric ceramic speakers. Each of them has a positive contact and a negative contact which respectively connect with a positive loop and a negative loop. The above-mentioned loops have at least two power wires not wrapped by plastic. Water may induce electric conduction between the exposed power wires and result in short circuit and damage of the piezoelectric ceramic speaker.

In order to secure the ceramic plate to a firm baseplate but still allow the ceramic plate to vibrate after receiving signals, a vibratile medium is interposed between the ceramic plate and the baseplate, and a space for vibration of the ceramic plate is formed in the baseplate. Thereby, the ceramic plate resonates with the vibratile medium in the space to generate sounds. For an example of the vibratile medium, it can be an elastic pad made of rubber or foamed plastic and connected with the bottom of the ceramic speaker in the above-mentioned Taiwan patent No. M426235. However, the conventional piezoelectric ceramic speaker has only a single vibratile medium, which is less likely to achieve a satisfactory resonance effect.

SUMMARY OF THE INVENTION

The primary objective of the present invention is to provide sufficient waterproofness for the piezoelectric ceramic speaker without changing the density of the ceramic material.

Another objective of the present invention is to improve the unsatisfactory resonance effect in the conventional piezoelectric ceramic speaker that has only a single vibratile medium connected with the ceramic plate.

To achieve the above-mentioned objectives, the present invention proposes a waterproof piezoelectric ceramic speaker which comprises a ceramic composite and a vibration membrane.

The ceramic composite includes a ceramic plate and a driving electrode assembly arranged on the ceramic plate and supplying a driving voltage to the ceramic plate to generate vibration for the ceramic plate. The vibration membrane includes a first vibration layer and a second vibration layer respectively adhered to two opposite surfaces of the ceramic composite. Each of the first vibration layer and the second vibration layer has a resonance member adhered to the ceramic plate and vibrating simultaneously with the ceramic plate, a waterproof member connecting with the resonance member to seal the driving electrode assembly, and a bonding member extending from the perimeter of the resonance member to seal the resonance member.

In one embodiment, a first conductive layer and a second conductive layer are arranged on the ceramic plate to receive the driving voltage and sealed by the resonance members of the first and second vibration layers.

In one embodiment, the driving electrode assembly includes a first electric wire and a second electric wire which are respectively connected with the first conductive layer and the second conductive layer and sealed by the waterproof members of the first and second vibration layers. The first electric wire and the second electric wire connect with a power source to generate a driving voltage therebetween.

In one embodiment, the present invention further comprises a support plate for securing the vibration membrane. The support plate includes a securing frame for fastening the bonding members of the first and second vibration layers, a first vibration basin connecting with the securing frame for accommodating the ceramic plate, and a plurality of first sound holes interconnecting with the first vibration basin.

In one embodiment, the present invention further comprises a protection plate engaging with the support plate. The protection plate includes an engagement frame corresponding to the securing frame, a second vibration basin connecting with the engagement frame for accommodating the ceramic plate, and a plurality of second sound holes interconnecting with the second vibration basin. The first and second vibration basins of the support plate and the protection plate form a vibration space allowing the ceramic plate to vibrate thereinside.

In one embodiment, the first vibration layer and the second vibration layer are two independent vibration membranes.

In one embodiment, the first vibration layer and the second vibration layer are connected to form an integral vibration membrane.

In comparison with the conventional technology, the present invention has the following advantages:

1. Better resonance effect: the conventional piezoelectric Ceramic speaker is hard to achieve a satisfactory resonance effect because it has only a single vibratile medium connected with the ceramic plate. However, the vibration membrane of the present invention has a first vibration layer and a second vibration layer respectively adhered to two opposite surfaces of the ceramic composite. While the ceramic composite is driven by the voltage to vibrate, the first and second vibration layers resonate with the ceramic composite synchronously. Therefore, the present invention has a better resonance effect.

2. Better waterproofness: the conventional technology enhances The waterproofness of the piezoelectric ceramic speaker via increasing the density of the ceramic plate. However, increasing the density of the ceramic plate is likely to generate high-frequency sounds that are shrill and harsh to the ears. The present invention uses the resonance members and waterproof members of the first and second vibration layers to seal the first and second conductive layers and the driving electrode assembly on the ceramic plate. Therefore, the present invention can achieve better waterproofness without increasing the density of the ceramic plate.

DETAILED DESCRIPTION OF THE PREFERRED EMBODIMENTS

The technical contents of the present invention will be described in detail in cooperation with the drawings below.

Figure 1:
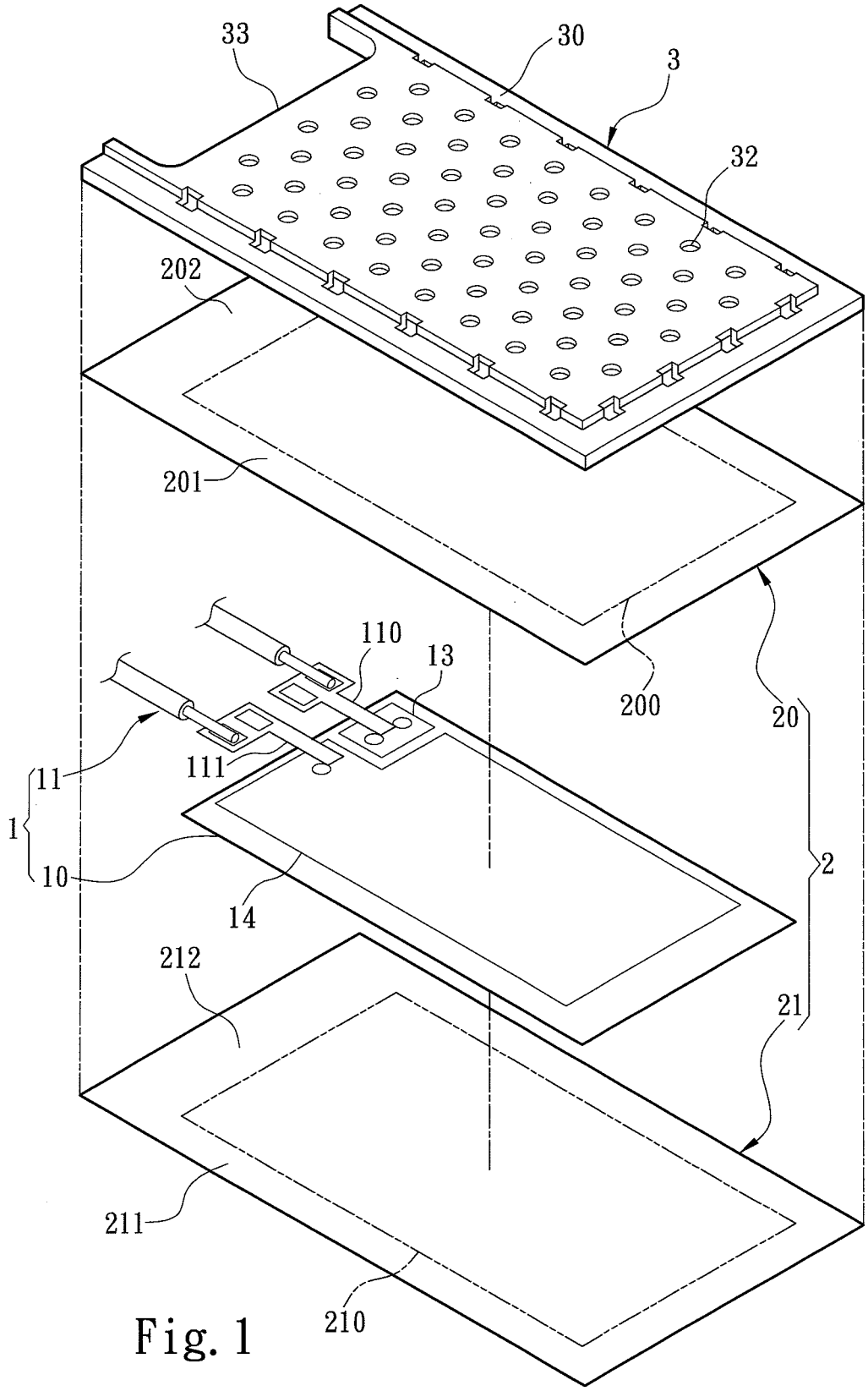
FIG. 1 is an exploded view of a waterproof piezoelectric ceramic speaker according to a first embodiment of the present invention.
Figure 2:
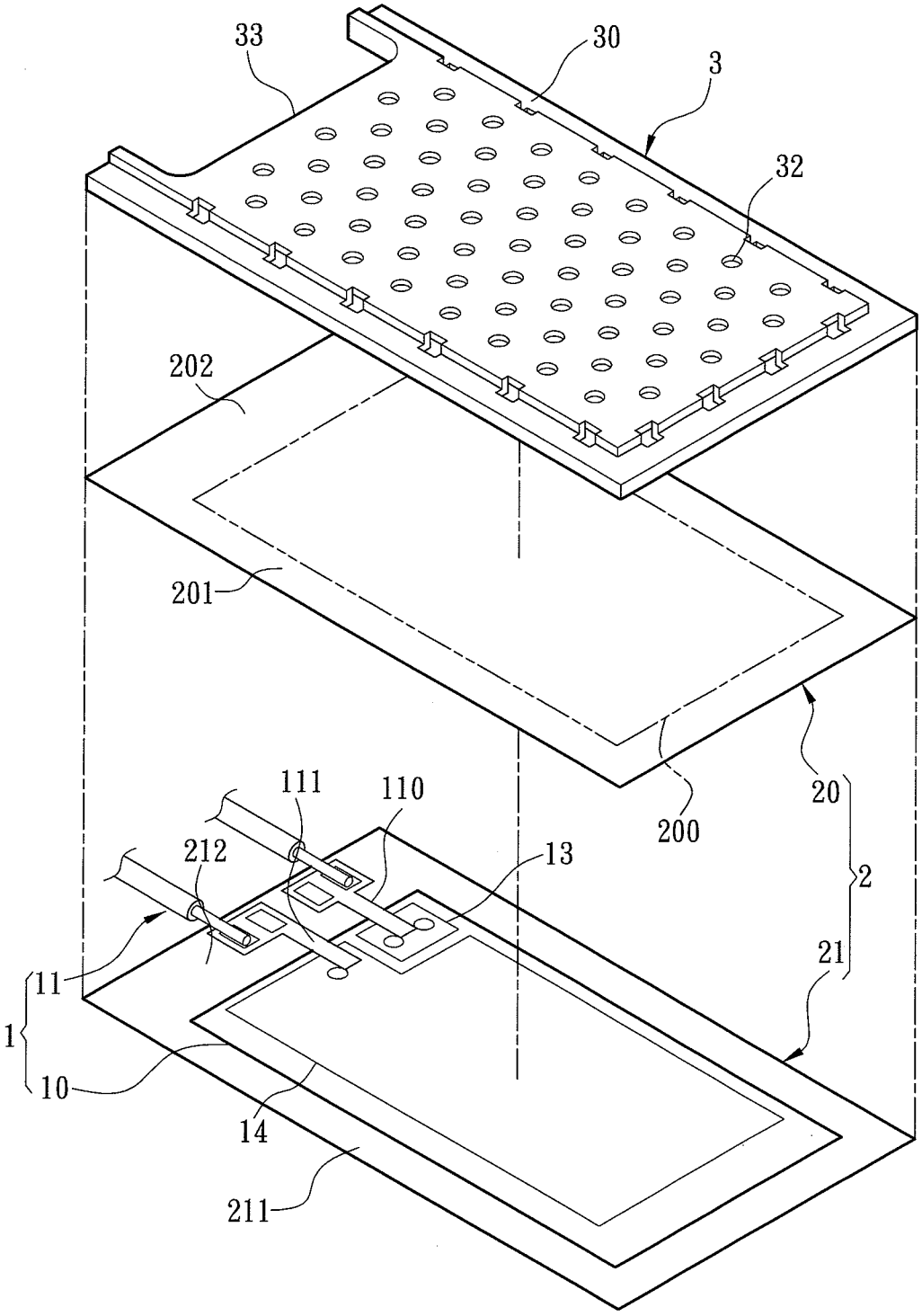
FIG. 2 is another exploded view of the waterproof piezoelectric ceramic speaker according to the first embodiment of the present invention.

Refer to FIG. 1 and FIG. 2 for exploded views of a waterproof piezoelectric ceramic speaker according to a first embodiment of the present invention. The waterproof piezoelectric ceramic speaker of the present invention comprises a ceramic composite 1, a vibration membrane 2 and a support plate 3. The ceramic composite 1 includes a ceramic plate 10 and a driving electrode assembly 11 arranged on the ceramic plate 10 and supplying a driving voltage to the ceramic plate 10 to generate vibration for the ceramic plate 10. A first conductive layer 13 and a second conductive layer 14 are arranged on the ceramic plate 10 to receive the driving voltage. The driving electrode assembly 11 has a first electric wire 110 and a second electric wire 111 which respectively connect with the first conductive layer 13 and the second conductive layer 14. The first electric wire 110 and the second electric wire 111 also connect with a power source to generate the driving voltage therebetween.

The vibration membrane 2 includes a first vibration layer 20 and a second vibration layer 21 respectively adhered to two opposite surfaces of the ceramic composite 1. The first vibration layer 20 and the second vibration layer 21 respectively have a resonance member 200 and 210 adhered to the ceramic plate 10, and a bonding member 201 and 211 extending from a perimeter of the resonance member 200 and 210 to seal the resonance member 200 and 210. The support plate 3 includes a securing frame 30 for securing the bonding members 201 and 211 of the first and second vibration layers 20 and 21, a first vibration basin 31 (shown in FIG. 3) connecting with the securing frame 30 for accommodating the ceramic plate 10, and a plurality of first sound holes 32 interconnecting with the first vibration basin 31.

Figure 3:
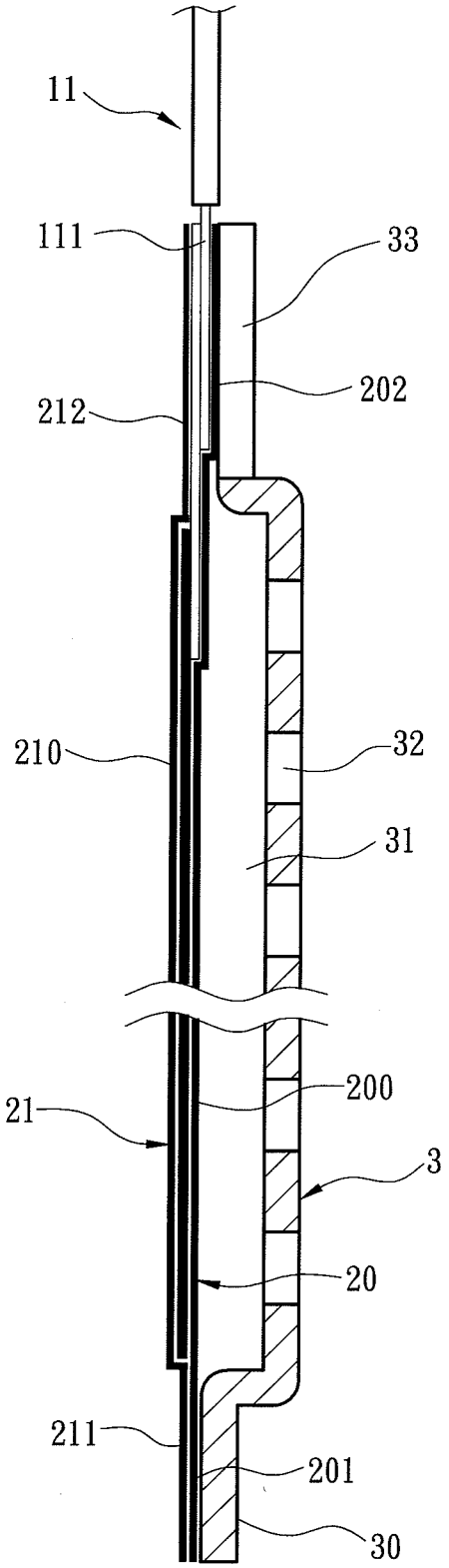
FIG. 3 is a cross-section of the waterproof piezoelectric ceramic speaker according to the first embodiment of the present invention.

Refer to FIG. 3 for a cross-section of a waterproof piezoelectric ceramic speaker according to the first embodiment of the present invention. The ceramic plate 10 is secured to the securing frame 30 via fastening the bonding members 201 and 211 to the securing frame 30. While the ceramic plate 10 receives the driving voltage and vibrates, the resonance member 200 of the first vibration layer 20 and the resonance member 210 of the second vibration layer 21 resonate synchronously with the ceramic plate 10 in the first vibration basin 31. The air in the first vibration basin 31 is compressed during vibration of the ceramic plate 10 to generate sounds. The sounds are sent out via the first sound holes 32. Compared with the conventional piezoelectric ceramic speakers that use only a single vibratile medium, the piezoelectric ceramic speaker of the present invention adopts two vibration layers, i.e. the first vibration layer 20 and the second vibration layer 21. Therefore, the present invention can achieve a better resonance effect.

Refer to FIG. 1 and FIG. 2 again. To achieve waterproofness, the first vibration layer 20 and the second vibration layer 21 seal the first conductive layer 13 and the second conductive layer 14 through the resonance members 200 and 210. The first vibration layer 20 and the second vibration layer 21 respectively have a waterproof member 202 and 212 connecting with the resonance member 200 and 210 to seal the driving electrode assembly 11. The first electric wire 110 and the second electric wire 111 are sealed by the waterproof members 202 and 212. Each of the first electric wire 110 and the second electric wire 111 has a contact formed on the ceramic plate 10, a metallic plate connecting with the contact and formed on the waterproof member 202 or 212, and a bare wire portion connecting with the metallic plate and formed at one end of the cable. The metallic plate and the bare wire portion are arranged on the waterproof member 212 and electrically connected with the power source, whereby the first electric wire 110 and the second electric wire 111 can receive the driving voltage.

The support plate 3 further comprises a wire hole 33 where the first electric wire 110 and the second electric wire 111 pass through. If the first electric wire 110 and the second electric wire 111 are not sealed, they are likely to be short-circuited by water. Therefore, the present invention uses the waterproof members 202 and 212 to seal the first electric wire 110 and the second electric wire 111 and isolate them from humidity. In the first embodiment, the first vibration layer 20 and the second vibration layer 21 are two independent vibration membranes. In another embodiment, the first vibration layer 20 and the second vibration layer 21 are connected to form an integral vibration membrane.

Figure 4:
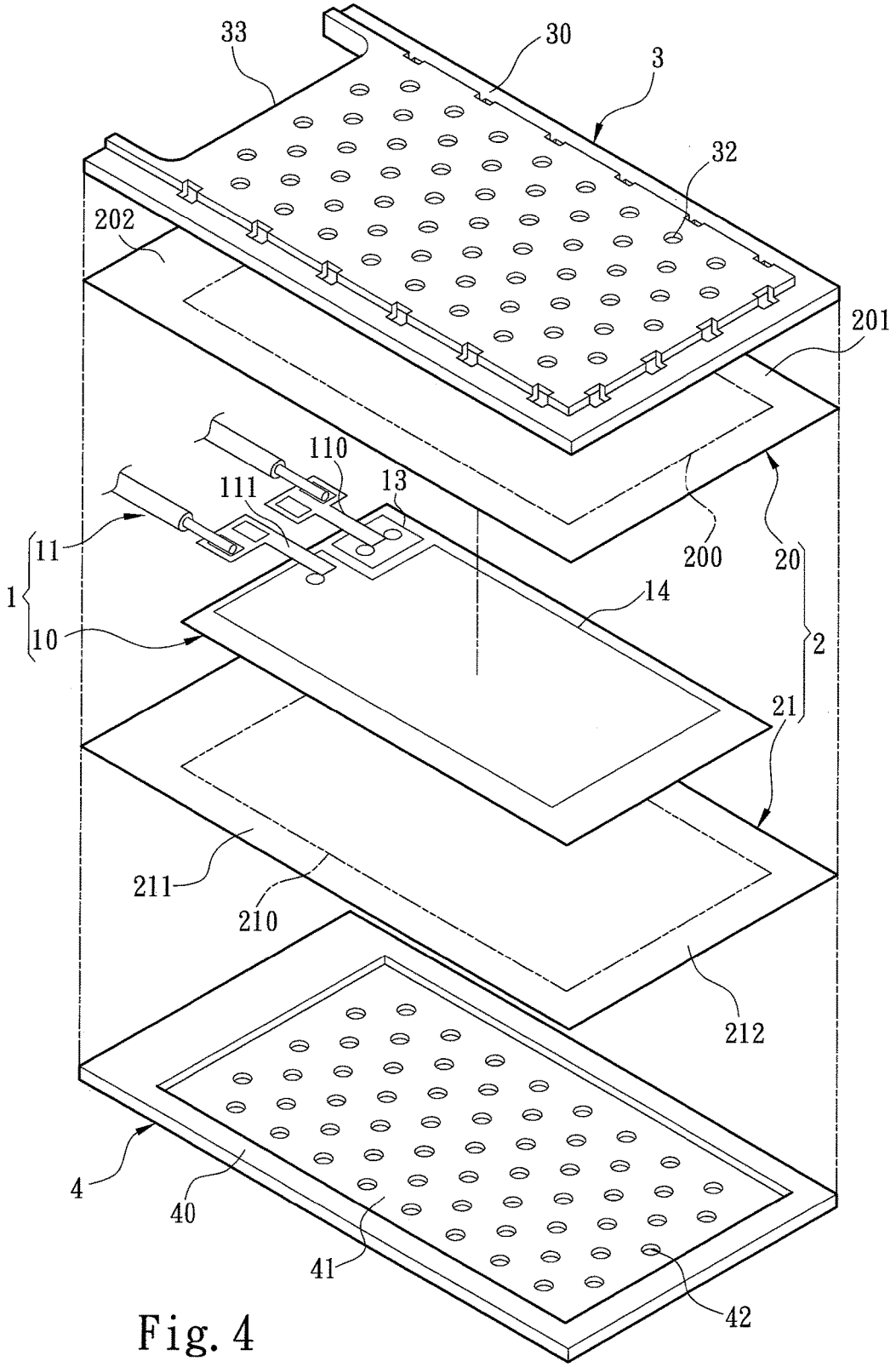
FIG. 4 is an exploded view of a waterproof piezoelectric ceramic speaker according to a second embodiment of the present invention.

Refer to FIG. 4 for an exploded view of a waterproof piezoelectric ceramic speaker according to a second embodiment of the present invention. In the second embodiment, the waterproof piezoelectric ceramic speaker of the present invention further comprises a protection plate 4 which engages with the support plate 3 to protect the fragile ceramic plate 10 from impact. The structure of the protection plate 4 is similar to that of the support plate 3. The protection plate 4 includes an engagement frame 40 corresponding to the securing frame 30, a second vibration basin 41 connecting with the engagement frame 40 for accommodating the ceramic plate 30, and a plurality of second sound holes 42 interconnecting with the second vibration basin 41.

Figure 5:
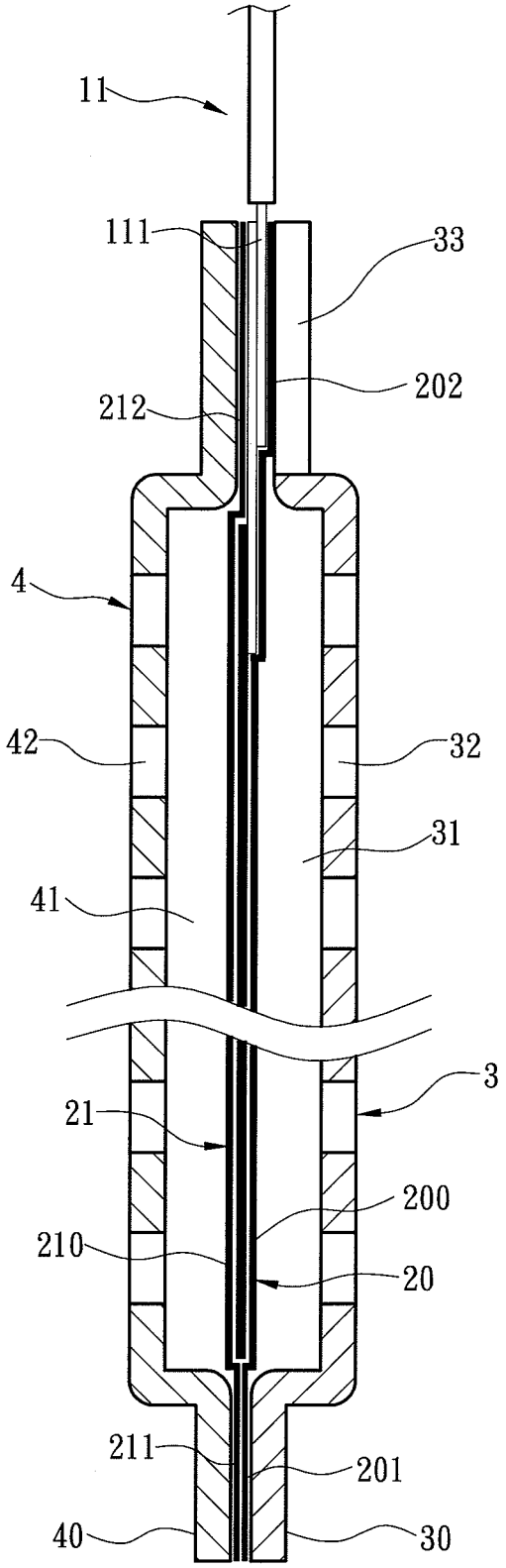
FIG. 5 is a cross-section of the waterproof piezoelectric ceramic speaker according to the second embodiment of the present invention.

Refer to FIG. 5 for a cross-section of a waterproof piezoelectric ceramic speaker according to the second embodiment of the present invention. The bonding members 201 and 211 are interposed between the securing frame 30 and the engagement frame 40. While the ceramic plate 10 receives the driving voltage and vibrates, the resonance members 200 and 210 resonate with the ceramic plate 10 synchronously inside the vibration space formed by the first and second vibration basins 31 and 41. The air in the vibration space is compressed to generate sounds. Then, the sounds are sent out via the first and second sound holes 32 and 42.

In the present invention, the vibration membrane includes a first vibration layer and a second vibration layer respectively adhered to two opposite surfaces of the ceramic composite. Each of the first vibration layer and the second vibration layer has a resonance member adhered to the ceramic plate and resonating synchronously with the ceramic plate, and a waterproof member sealing the driving electrode assembly. Via the resonance members and the waterproof members, the present invention not only can achieve a better resonance effect, but also can have a better waterproof function without increasing the density of the ceramic plate. Therefore, the present invention possesses utility, novelty and non-obviousness and meets the condition for a patent. Thus, the Inventors file the application for a patent. It is appreciated if the patent is approved fast.

The present invention has been described in detail with the embodiments. However, these embodiments are not intended to limit the scope of the present invention but only to exemplify the present invention. Any equivalent modification or variation according to the spirit of the present invention is to be also included within the scope of the present invention.

What is claimed is:

1. A waterproof piezoelectric ceramic speaker, comprising:

a ceramic composite including a ceramic plate and a driving electrode assembly arranged on a lateral side of the ceramic plate and supplying a driving voltage to the ceramic plate to generate vibration for the ceramic plate, the ceramic plate including a first conductive region and a second conductive region arranged in a same plane of the ceramic plate to receive the driving voltage, the driving electrode assembly including a first electric wire and a second electric wire which are respectively connected with the first conductive region and the second conductive region; and a vibration membrane including a first vibration layer and a second vibration layer respectively adhered to two opposite surfaces of the ceramic composite, wherein the first vibration layer and the second vibration layer respectively have a resonance member adhered to the ceramic plate and resonating with the ceramic plate synchronously, a waterproof member extending from a perimeter of the resonance member to seal the first electric wire and the second electric wire, and a bonding member extending from the perimeter of the resonance member and connecting with the waterproof member to seal the resonance member.

2. The waterproof piezoelectric ceramic speaker according to claim 1, wherein the first and second electric wires are connected with a power source to generate the driving voltage therebetween.

3. The waterproof piezoelectric ceramic speaker according to claim 1 further comprising a support plate for securing the vibration membrane, wherein the support plate includes a securing frame for fastening the bonding members of the first and second vibration layers, a first vibration basin connecting with the securing frame and accommodating the ceramic plate, and a plurality of first sound holes interconnecting with the first vibration basin.

4. The waterproof piezoelectric ceramic speaker according to claim 3 further comprising a protection plate engaging with the support plate, wherein the protection plate includes an engagement frame corresponding to the securing frame, a second vibration basin connecting with the engagement frame and accommodating the ceramic plate, and a plurality of second sound holes interconnecting with the second vibration basin, and wherein the first vibration basin of the support plate and the second vibration basin of the protection plate jointly form a vibration space allowing the ceramic plate to vibrate thereinside.

5. The waterproof piezoelectric ceramic speaker according to claim 1, wherein the first vibration layer and the second vibration layer are two independent vibration membranes.

6. The waterproof piezoelectric ceramic speaker according to claim 1, wherein the first vibration layer and the second vibration layer are connected to form an integral vibration membrane.

* * * * *